US010456938B2

(12) United States Patent
Wu

(10) Patent No.: US 10,456,938 B2
(45) Date of Patent: Oct. 29, 2019

(54) SHEATH AND KNIFE SEPARATION CONTROL STRUCTURE

(71) Applicant: Race Wu, Taichung (TW)

(72) Inventor: Race Wu, Taichung (TW)

( * ) Notice: Subject to any disclaimer, the term of this patent is extended or adjusted under 35 U.S.C. 154(b) by 0 days.

(21) Appl. No.: 16/034,858

(22) Filed: Jul. 13, 2018

(65) Prior Publication Data

US 2019/0054642 A1 Feb. 21, 2019

(30) Foreign Application Priority Data

Aug. 17, 2017 (TW) ..... 106128009 A

(51) Int. Cl.
*B26B 29/02* (2006.01)
*B26B 3/06* (2006.01)

(52) U.S. Cl.
CPC ..... *B26B 29/025* (2013.01); *B26B 3/06* (2013.01)

(58) Field of Classification Search
CPC ..... B26B 29/025; B26B 3/06; B25F 1/00; B21K 11/02
USPC ..... 30/151; 224/232
See application file for complete search history.

(56) References Cited

U.S. PATENT DOCUMENTS 3,958,330 A * 5/1976 Hutchens ..... B26B 29/025 30/151
9,254,577 B2 * 2/2016 Kommer ..... B26B 29/025
2006/0175366 A1 * 8/2006 Dekaise ..... F41C 33/0227 224/243
2007/0266569 A1 * 11/2007 Nenadic ..... B26B 3/06 30/151
2013/0026054 A1 * 1/2013 Adams ..... A45F 5/14 206/349

* cited by examiner

*Primary Examiner* — Kenneth E Peterson
*Assistant Examiner* — Liang Dong
(74) *Attorney, Agent, or Firm* — Muncy, Geissler, Olds & Lowe, P.C.

(57) ABSTRACT

A sheath and knife separation control structure includes a sheath formed of a first sheath shell and a second sheath shell and including a knife blade accommodation chamber and a stop block, a knife having a knife blade accommodated in the knife blade accommodation chamber and a stop portion stoppable by the stop block, and a clamping control unit including a clamp pivotally connected to the sheath and a first clamping portion and a second clamping portion adapted for clamping the first sheath shell and second sheath shell of the sheath such that the stop block of the sheath is stopped against the stop portion to lock the knife to the sheath. The stop portion is movable to push away the stop block for allowing separation of the knife from the sheath when the clamping control unit is unclamped from the sheath.

9 Claims, 8 Drawing Sheets

SHEATH AND KNIFE SEPARATION CONTROL STRUCTURE

BACKGROUND OF THE INVENTION

1. Field of the Invention

The present invention relates to knife and sheath arrangements and more particularly, to a sheath and knife separation control structure.

2. Description of the Related Art

A separation control structure for sheath and knife is known, which uses a fastener to lock the knife to the sheath. In operation, the user needs to unfasten the fastener so that the knife can be separated from the sheath. If the fastener is not accurately unfastened, the sheath and the knife cannot be rapidly separated, causing inconvenience in use.

SUMMARY OF THE INVENTION

The present invention has been accomplished under the circumstances in view. It is the main object of the present invention to provide a sheath and knife separation control structure, which is operable between a clamped position where the knife is locked to the sheath and an unclamped position where the knife is separable from the sheath.

To achieve this and other objects of the present invention, a sheath and knife separation control structure comprises a sheath, a knife and a clamping control unit. The sheath is formed of a first sheath shell and a second sheath shell, comprising a knife blade accommodation chamber and a stop block. The knife comprises a knife blade accommodated in the knife blade accommodation chamber of the sheath, and a stop portion stoppable by the stop block of the sheath. The clamping control unit comprises a clamp pivotally connected to the sheath, and a first clamping portion and a second clamping portion adapted for clamping the first sheath shell and second sheath shell of the sheath so that the stop block of the sheath is stopped against the stop portion of the knife to lock the knife to the sheath. Further, the stop portion of the knife is movable to push away the stop block of the sheath for allowing separation of the knife from the sheath when the first clamping portion and second clamping portion of the clamping control unit are unclamped from the first sheath shell and second sheath shell of the sheath.

Preferably, the sheath further comprises a knife handle accommodation chamber for accommodating the knife handle of the knife. The knife handle accommodation chamber of the sheath is capable of clamping the knife handle of the knife.

Preferably, the clamping control unit comprises a torsion spring adapted for biasing the clamp to an unclamped position away from the sheath.

Preferably, the sheath further comprises a retaining groove. The clamping control unit further comprises a locking rod movable into the retaining groove of the sheath to prohibit the clamping control unit from biasing relative to the sheath.

Preferably, the clamping control unit further comprises a push spring stopped with one end thereof against the locking rod, and a spring stopper block stopped at an opposite end of the push spring.

Preferably, the clamping control unit further comprises a screw sleeve mounted in the first pivot portion of the clamp, a barrel mounted between the screw sleeve and a second pivot portion of the clamp, and a screw bolt inserted through the second pivot portion of the clamp and the barrel and threaded into the screw sleeve.

Other advantages and features of the present invention will be fully understood by reference to the following specification in conjunction with the accompanying drawings, in which like reference signs denote like components of structure.

DETAILED DESCRIPTION OF THE INVENTION

Figure 1:
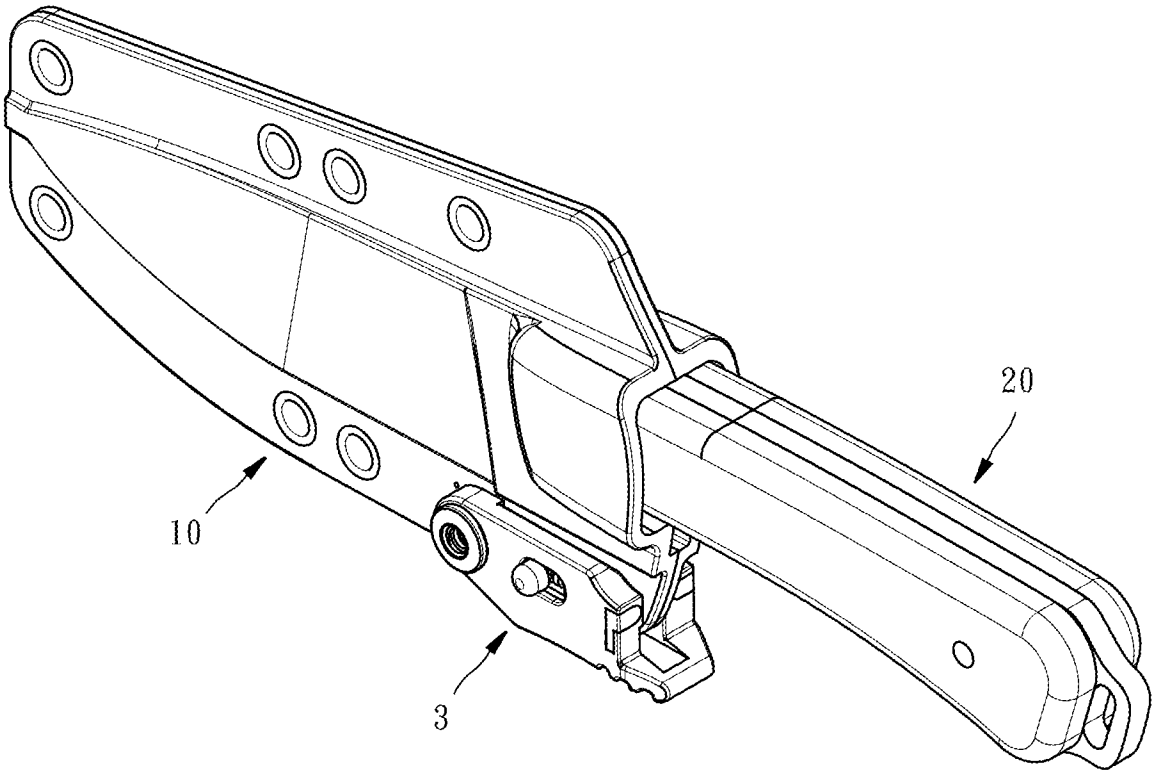
FIG. 1 is an oblique top elevational assembly view of a sheath and knife separation control structure in accordance with the present invention.
Figure 2:
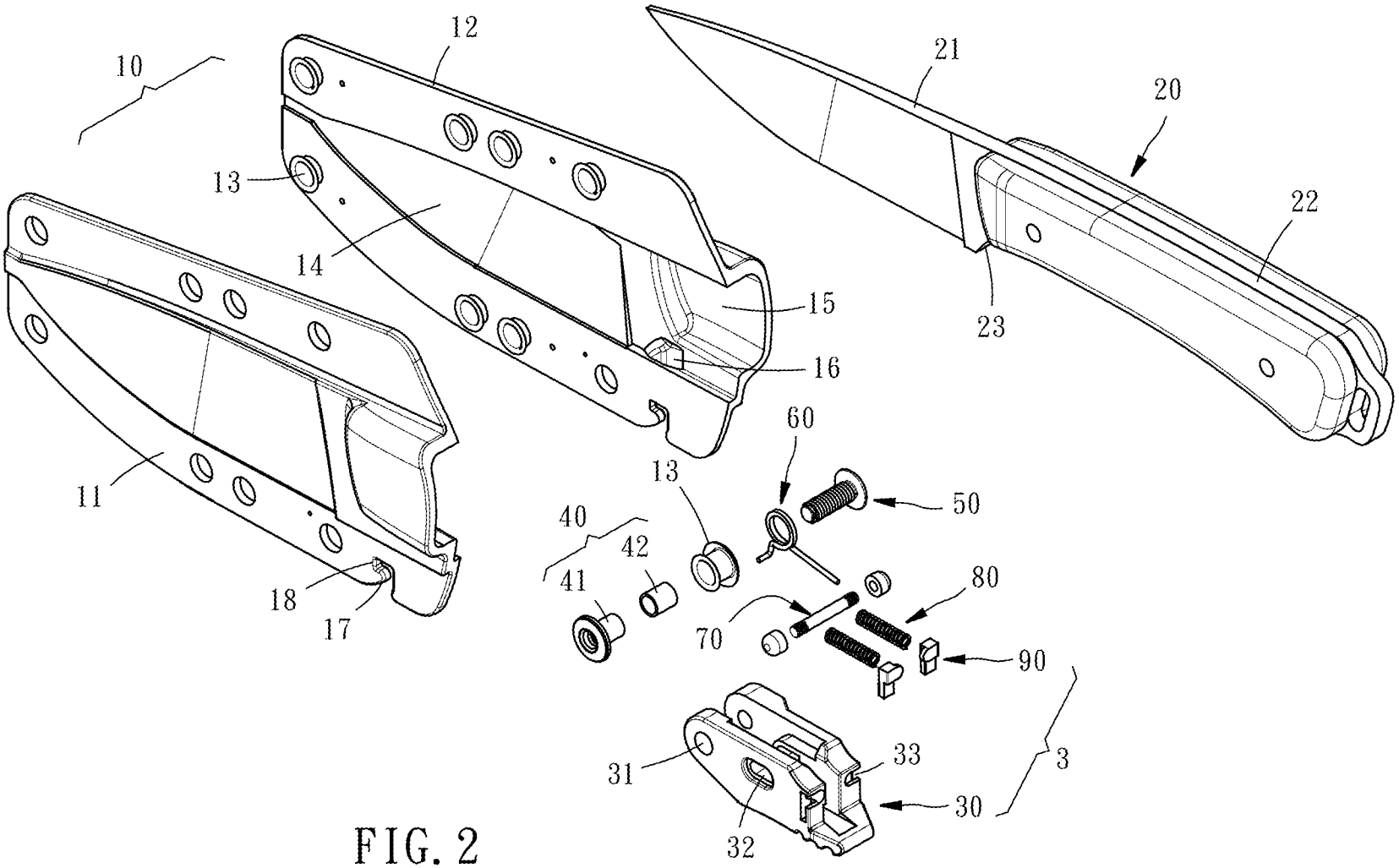
FIG. 2 is an exploded view of the sheath and knife separation control structure in accordance with the present invention.
Figure 3:
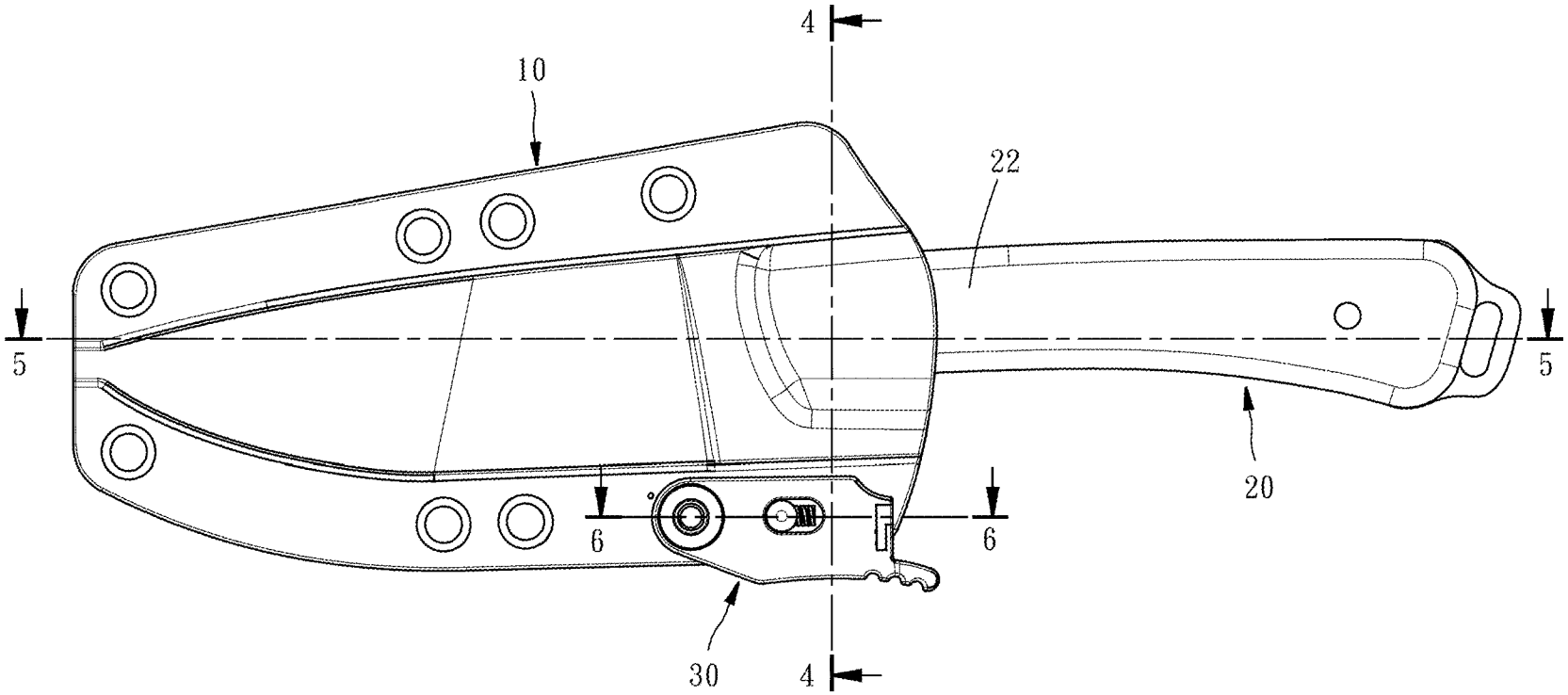
FIG. 3 is a schematic front assembly view of the sheath and knife separation control structure in accordance with the present invention.
Figure 4:
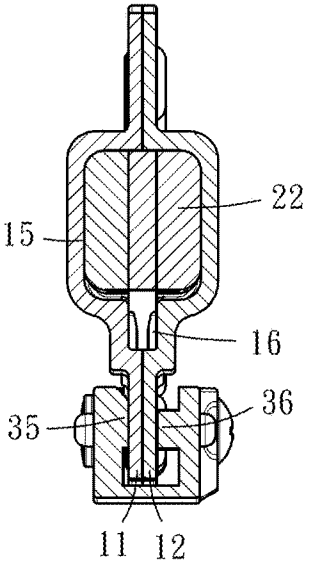
FIG. 4 is a sectional view taken along line 4-4 of FIG. 3.
Figure 5:
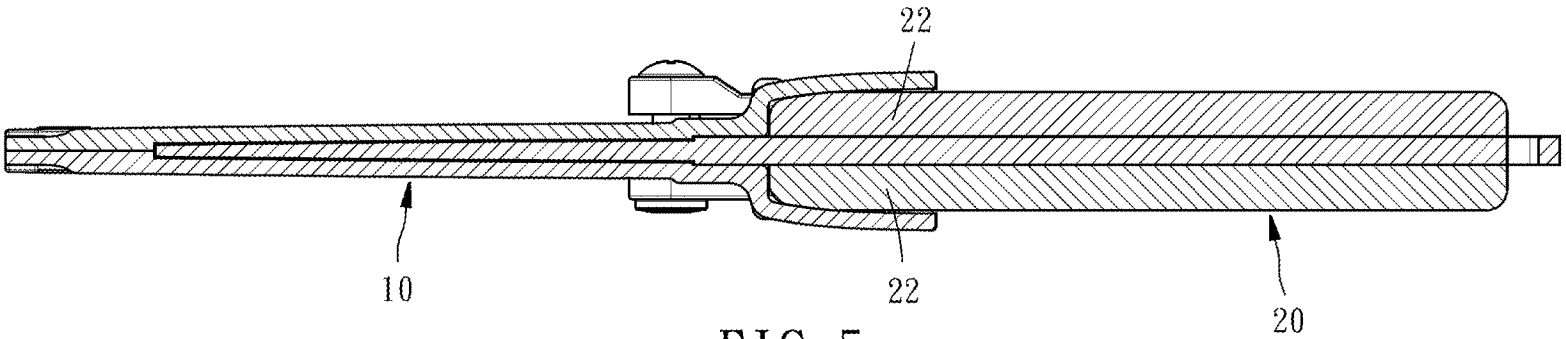
FIG. 5 is a sectional view taken along line 5-5 of FIG. 3.
Figure 6:
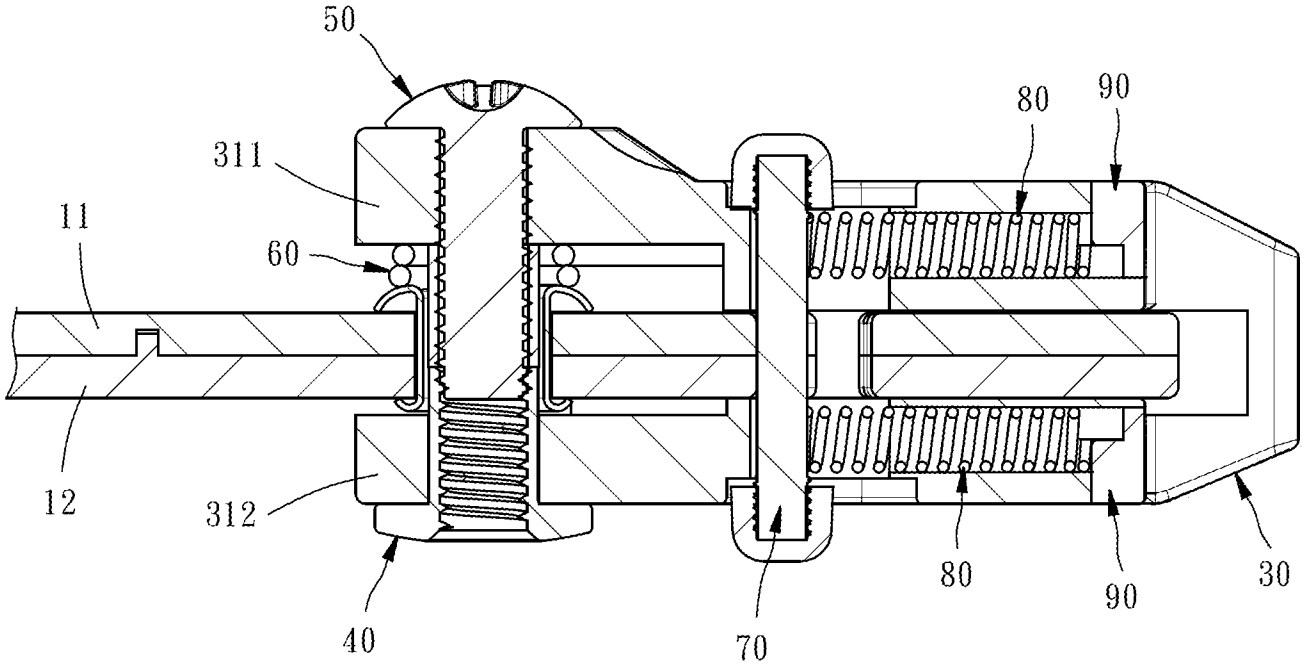
FIG. 6 is a sectional view taken along line 6-6 of FIG. 3.
Figure 7:
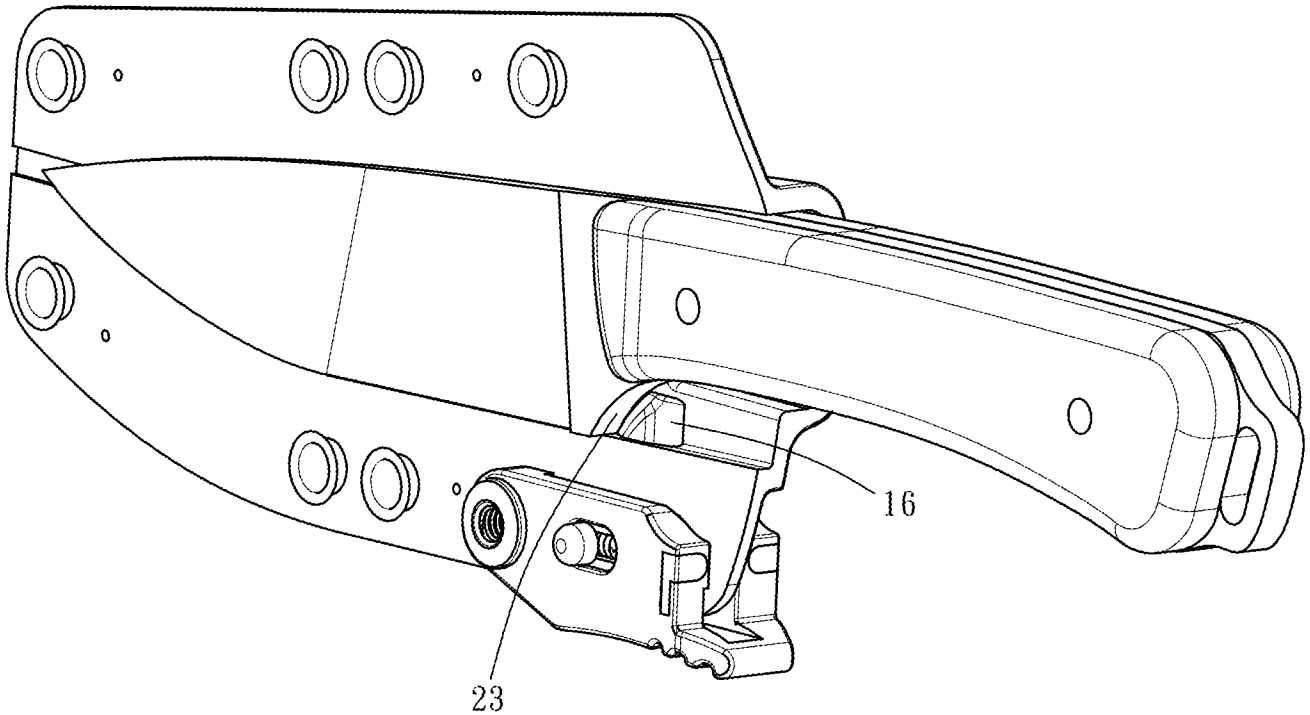
FIG. 7 is similar to FIG. 1, illustrating the status of the sheath and knife separation control structure after removal of the first sheath shell.
Figure 8:
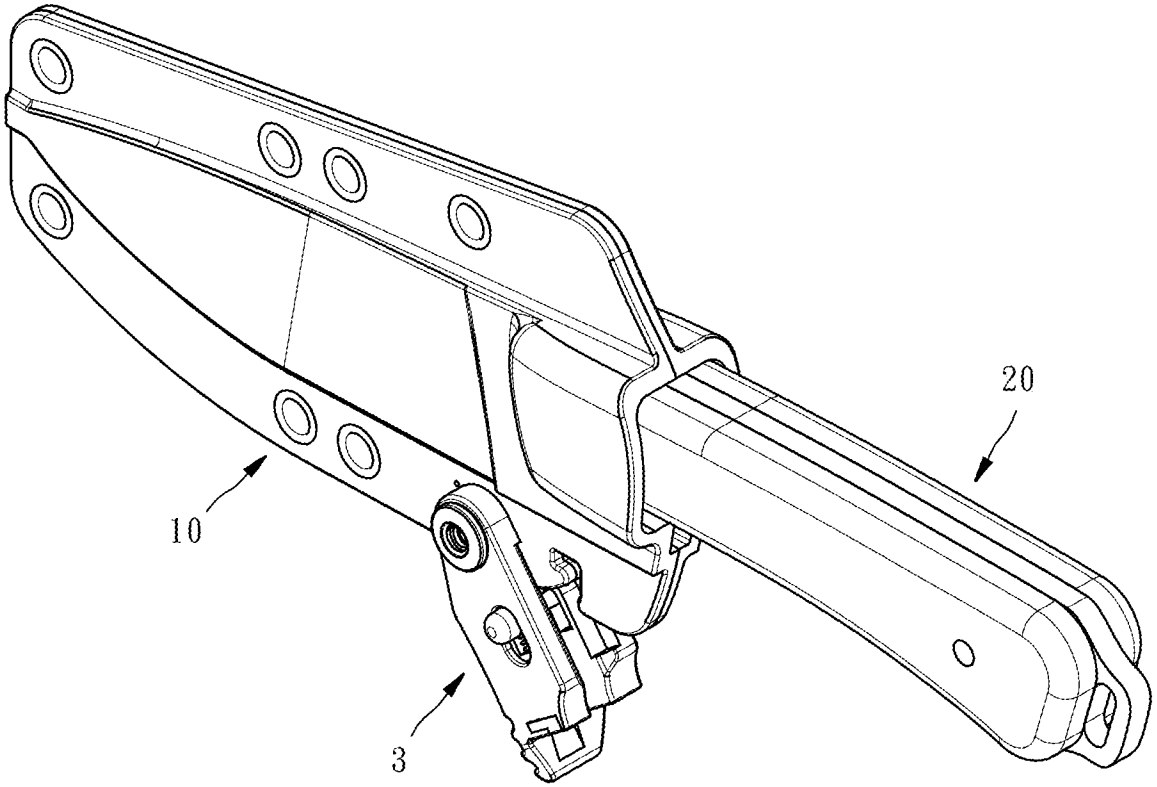
FIG. 8 is similar to FIG. 1, illustrating the clamp of the clamping control unit biased.
Figure 9:
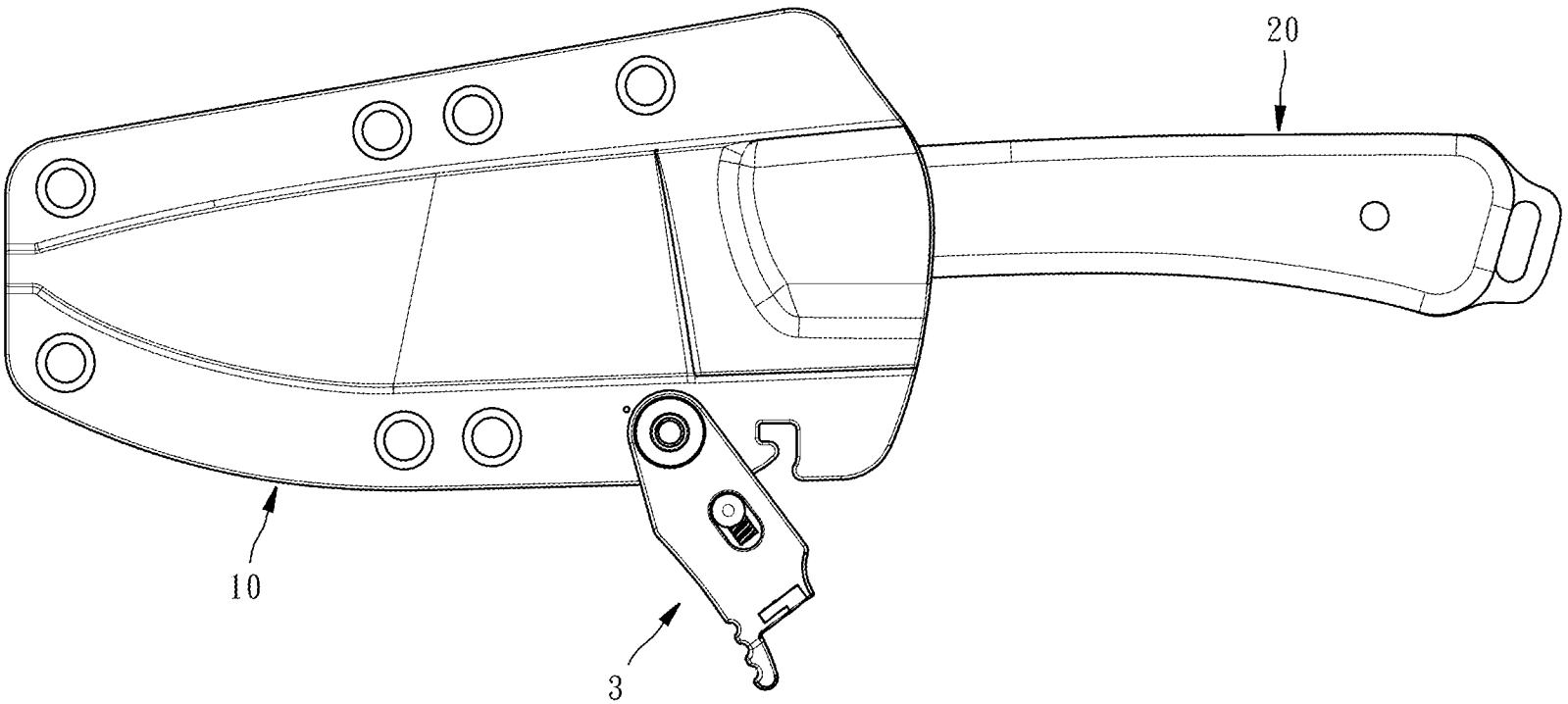
FIG. 9 is a front view of FIG. 8.

Referring to FIGS. 1-9, a sheath 10 and knife 20 separation control structure in accordance with the present invention is shown. The sheath and knife separation control structure comprises a sheath 10, a knife 20 and a clamping control unit 3.

The sheath 10 is a combination of a first sheath shell 11 and a second sheath shell 12. The first sheath shell 11 and the second sheath shell 12 are fastened together with rivets 13, defining therein a knife blade accommodation chamber 14 and a knife handle accommodation chamber 15. The first sheath shell 11 and the second sheath shell 12 each comprise a stop block 16, a rod sliding surface 17, and a retaining groove 18.

Preferably, the stop block 16 has two opposite sides thereof inclined or curved.

The knife 20 comprises a knife blade 21 and a knife handle 22 respectively accommodated in the knife blade accommodation chamber 14 and knife handle accommodation chamber 15 of the sheath 10. The knife 20 further comprises a stop portion 23 stoppable by the stop block 16 of the sheath 10.

The stop portion 23 in this embodiment is connected to, for example, one end of the knife blade 21, however, this connection location is not a limitation.

The clamping control unit 3 comprises a clamp 30 and a pivot connection device 40 pivotally connected to the sheath 10. In this embodiment, the pivot connection device 40 is connected to one rivet 13.

The clamp 30 comprises a first pivot portion 311 and a second pivot portion 312. The first pivot portion 311 and the second pivot portion 312 each comprise a pivot hole 31, a sliding slot 32, a stop block engagement groove 33, a first clamping portion 35 and a second clamping portion 36. The first pivot portion 311 and the second pivot portion 312 can clamp the first sheath shell 11 and second sheath shell 12 of the sheath 10, causing the knife handle accommodation chamber 15 of the sheath 10 to clamp the knife handle 22 of the knife 20.

The pivot connection device 40 comprises a screw sleeve 41 mounted in the first pivot portion 311 of the clamp 30, a barrel 42 mounted between the screw sleeve 41 and the second pivot portion 312 of the clamp 30, and a screw bolt 50 inserted through the second pivot portion 312 of the clamp 30 的及該 barrel 42 and threaded into the screw sleeve 41.

The clamping control unit 3 further comprises a torsion spring 60 for biasing the clamp 30 in direction away from the sheath 10.

The clamping control unit 3 further comprises a locking rod 70 movable into the retaining grooves 18 of the sheath 10 to lock the clamping control unit 3 to the sheath 10.

The clamping control unit 3 further comprises at least one spring stopper block 90 mounted in the stop block engagement grooves 33 of the clamp 30, and at least one push spring 80 mounted in the clamp 30 and stopped between the locking rod 70 and the at least one spring stopper block 90.

When assembling the sheath 10 and the knife 20, insert the knife 20 into the sheath 10. The torsion spring 60 normally biases the clamp 30 toward the open status. Thereafter, bias the clamp 30 with one finger toward the sheath 10 to overcome the spring force of the torsion spring 60, forcing the locking rod 70 into contact with the rod sliding surface 17 against the spring force of the push spring 80. When continuously biasing the clamp 30 in the same direction, the locking rod 70 is engaged into the retaining grooves 18 and temporarily prohibited from moving out of the retaining grooves 18.

At this time, the first clamping portion 35 and second clamping portion 36 of the clamp 30 are clamped on the first sheath shell 11 and second sheath shell 12 of the sheath 10, and the stop block 16 of the sheath 10 is stopped against the stop portion 23 of the knife 20 to prohibit separation of the knife 20 from the sheath 10.

Additionally, the knife handle accommodation chamber 15 of the sheath 10 clamps the knife handle 22 of the knife 20 to prohibit vibration of the knife 20 relative to the sheath 10.

When wishing to separate the sheath 10 and the knife 20, move the locking rod 70 upwardly away from the retaining grooves 18 to overcome the spring force of the push spring 80. At this time, bias the clamping control unit 3 to release the clamping force of the first clamping portion 35 and the second clamping portion 36 from the first sheath shell 11 and second sheath shell 12 of the sheath 10, allowing the stop portion 23 of the knife 20 to push away the stop block 16 of the sheath 10. Thus, the knife handle accommodation chamber 15 of the sheath 10 is released from the knife handle 22 of the knife 20, allowing separation of the knife 20 from the sheath 10.

In addition to the above embodiment, the present invention can also be implemented as follows:

For example, the locking rod 70 can be mounted in the sheath 10; the retaining grooves 18 can be provided at the clamp 30.

In summary, the present invention uses the clamping control unit 3 to or not to clamp the sheath 10 so that the knife is separable from the sheath by an external force when the clamping control unit is in the unclamped position, or the knife is locked to the sheath when the clamping control unit is in the clamped position, the knife is locked to the sheath.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A sheath (10) and knife (20) separation control structure, comprising:

a sheath (10) formed of a first sheath shell (11) and a second sheath shell (12), said sheath (10) comprising a knife blade accommodation chamber (14) and a stop block (16);

a knife (20) comprising a knife blade (21) accommodated in said knife blade accommodation chamber (14) of said sheath (10) and a stop portion (23) stoppable by said stop block (16) of said sheath (10); and a clamping control unit (3) comprising a clamp (30) pivotally connected to said sheath (10), a first clamping portion (35) and a second clamping portion (36), said first clamping portion (35) and said second clamping portion (36) being adapted for clamping said first sheath shell (11) and said second sheath shell (12) of said sheath (10) so that said stop block (16) of said sheath (10) is stopped against said stop portion (23) of said knife (20) to lock said knife (20) to said sheath (10), wherein said stop portion (23) of said knife (20) is movable to push away said stop block (16) of said sheath (10) for allowing separation of said knife (20) from said sheath (10) when said first clamping portion (35) and said second clamping portion (36) of said clamping control unit (3) are unclamped from said first sheath shell (11) and said second sheath shell (12) of said sheath (10).

2. The sheath (10) and knife (20) separation control structure as claimed in claim 1, wherein said sheath (10) comprises a knife handle accommodation chamber (15) for accommodating said knife handle (22) of said knife (20), said knife handle accommodation chamber (15) of said sheath (10) being capable of clamping said knife handle (22) of said knife (20).

3. The sheath (10) and knife (20) separation control structure as claimed in claim 2, wherein said clamping control unit (3) comprises a torsion spring (60) adapted for biasing said clamp (30) to an unclamped position away from said sheath (10).

4. The sheath (10) and knife (20) separation control structure as claimed in claim 1, wherein said clamping control unit (3) comprises a torsion spring (60) adapted for biasing said clamp (30) to an unclamped position away from said sheath (10).

5. The sheath (10) and knife (20) separation control structure as claimed in claim 1, wherein said sheath (10) further comprises a retaining groove (18); said clamping control unit (3) further comprises a locking rod (70) movable into said retaining groove (18) of said sheath (10) to prohibit said clamping control unit (3) from biasing relative to said sheath (10).

6. The sheath (10) and knife (20) separation control structure as claimed in claim 5, wherein said clamping control unit (3) further comprises a push spring (80) stopped with one end thereof against said locking rod (70), and a spring stopper block (90) stopped at an opposite end of said push spring (80).

7. The sheath (10) and knife (20) separation control structure as claimed in claim 6, wherein said clamping control unit (3) further comprises a screw sleeve (41)

mounted in said first pivot portion (311) of said clamp (30), a barrel (42) mounted between said screw sleeve (41) and a second pivot portion (312) of said clamp (30), and a screw bolt (50) inserted through said second pivot portion (312) of said clamp (30) and said barrel (42) and threaded into said screw sleeve (41).

8. The sheath (10) and knife (20) separation control structure as claimed in claim 5, wherein said clamping control unit (3) further comprises a screw sleeve (41) mounted in said first pivot portion (311) of said clamp (30), a barrel (42) mounted between said screw sleeve (41) and a second pivot portion (312) of said clamp (30), and a screw bolt (50) inserted through said second pivot portion (312) of said clamp (30) and said barrel (42) and threaded into said screw sleeve (41).

9. The sheath (10) and knife (20) separation control structure as claimed in claim 1, wherein said clamping control unit (3) further comprises a screw sleeve (41) mounted in said first pivot portion (311) of said clamp (30), a barrel (42) mounted between said screw sleeve (41) and a second pivot portion (312) of said clamp (30), and a screw bolt (50) inserted through said second pivot portion (312) of said clamp (30) and said barrel (42) and threaded into said screw sleeve (41).

* * * * *